US006072134A

United States Patent [19]

Sato et al.

[11] Patent Number: 6,072,134

[45] Date of Patent: Jun. 6, 2000

[54] KEY SWITCH DEVICE

[75] Inventors: Hirofumi Sato, Gifu; Masaya Funamoto, Kasugai, both of Japan

[73] Assignee: Brother Kogyo Kabushiki Kaisha, Nagoya, Japan

[21] Appl. No.: 09/317,178

[22] Filed: May 24, 1999

[30] Foreign Application Priority Data

May 25, 1998 [JP] Japan ..... 10-142759
May 25, 1998 [JP] Japan ..... 10-142760

[51] Int. Cl.[7] ..... H01H 13/70

[52] U.S. Cl. ..... 200/344

[58] Field of Search ..... 200/5 A, 512, 200/517, 344, 345; 400/490, 491, 491.2, 495, 495.1

[56] References Cited

U.S. PATENT DOCUMENTS

| | | | |
|---|---|---|---|
| 5,278,371 | 1/1994 | Watanabe et al. | 200/344 |
| 5,504,283 | 4/1996 | Kako et al. | 200/5 A |
| 5,695,047 | 12/1997 | Tanahashi | 200/344 |
| 5,746,308 | 5/1998 | Lin | 200/344 |
| 5,763,842 | 6/1998 | Tsai et al. | 200/5 A |
| 5,850,194 | 12/1998 | Lin | 341/22 |
| 5,878,872 | 3/1999 | Tsai | 200/344 |

*Primary Examiner*—Michael Friedhofer
*Attorney, Agent, or Firm*—Oliff & Berridge, PLC

[57] ABSTRACT

A thin key switch device engagement portions formed in a base plate at a reduced processing quantity as compared with a conventional key switch device by effectively utilizing the thickness of the base plate. The key switch device increases the keystroke quantity while reducing the height of the key top arranged in the key switch device, thereby realizing a low profile key switch device.

19 Claims, 13 Drawing Sheets

KEY SWITCH DEVICE

BACKGROUND OF THE INVENTION

1. Field of the Invention

The present invention relates to a key switch device provided with, between a key top and a base plate, a guide support member for guiding the vertical movement of the key top, the guide support member being constructed of two link members rotatably coupled in an intersecting configuration. More particularly, the present invention relates to a key switch device capable of effectively utilizing the thickness of the base plate such that a processing quantity for an engagement portion for engaging the link members with respect to the base plate can be reduced to thereby achieve a low-profile key switch device.

The present invention also relates to a key switch device capable of increasing a keystroke quantity while keeping a low-profile of the key switch device.

2. Description of Related Art

Conventionally, there have been proposed key switch devices provided with a key top having two pairs of engagement portions which are formed at four corners of a back surface of the key top, a base plate made of a thin metal plate having two pairs of engagement portions corresponding to the key top engagement portions, and a guide support member disposed between the key top and the base plate. The guide support member is constructed of two link members that are coupled in an intersecting configuration These intersecting link members are connected to the key top and the base plate respectively through the engagement portions.

A basic structure of the conventional key switch device of this type is explained below referring to FIG. 17. FIG. 17 is a cross sectional side view of the conventional key switch device.

In FIG. 17, a key switch device 100 is mainly constructed of a key top 101, a guide support member 102, and a base plate 103 which is a thin metal plate made of, for example, aluminum.

On a back surface of the key top 101, first engagement portions 104 having a circular hole and second engagement portions 105 having a slot are arranged respectively in pairs. It is to be noted that only one of the first engagement portions 104 is shown in FIG. 17 and the same applies to the second engagement portions 105. The guide support member 102 for guiding a vertical movement of the key top 101 is constructed by two link members 106 and 107 which are mutually rotatably coupled in an intersecting configuration at an axial support part 108. The link member 106 is provided with engagement pins 109 and 110. The link member 107 is provided with engagement pins 111 and 112. On the base plate 103, third engagement portions 113 are formed at positions corresponding to the first engagement portions 104 of the key top 101 by a drawing process. Similarly, fourth engagement portions 114 are formed at positions corresponding to the second engagement portions 105 of the key top 101 by a drawing process.

The pin 109 formed on the link member 106 at its upper end is rotatably engaged in the first engagement portion 104 of the key top 101. The pin 110 formed on the link member 106 at its lower end is slidably engaged in the fourth engagement portion 114 of the base plate 103. The pin 111 formed on the link member 107 at its upper end is slidably engaged in the second engagement portion 105 of the key top 101. The pin 112 formed on the link member 107 at its lower end is rotatably engaged in the third engagement portion 113 of the base plate 103. A rubber spring 115 provided with a movable electrode (not shown) on an inner upper wall is disposed between the third and fourth engagement portions 113 and 114 on the base plate 103. Above the rubber spring 115, an axial support part 108 of the guide support member 102 is placed.

The key switch device 100 constructed as above is operated in the following manner. When the key top 101 is depressed, as shown in FIG. 19, the key top 101 is guided downward maintaining its horizontal state through the guide support member 102, and then the rubber spring 115 is buckled by the axial support part 108. Then, the movable electrode of the rubber spring 115 carries out a predetermined switching operation in cooperation with a switching circuit (not shown) provided on the base plate 103.

In the conventional key switch device 100, as shown in FIG. 17, the following distances are set to be equal; a distance L1 between the upper pin 109 of the link member 106 and the axial support part 108; a distance L2 between the lower pin 110 and the axial support part 108; a distance L3 between the upper pin 111 of the link member 107 and the axial support part 108; and a distance L4 between the lower pin 112 and the axial support part 108.

Meanwhile, the base plate 103 used in the key switch 100 is formed of a thin aluminum plate for rust prevention and reduction in weight. The third and fourth engagement portions 113 and 114 are formed by drawing a part of the thin aluminum plate.

The aluminum itself in metal material that is not expansible, though it is suitable for the purposes such as rust prevention and weight reduction. Thus, the third and fourth engagement portions 113 and 114 formed by a drawing process may easily be cut or broken at an upper portion during the drawing process. If the upper portions are cut or broken, the third and fourth engagement portions 113 and 114 can not support the rotation of the pin 112 and the slide of the pin 110, which interferes a smooth operation of the key top 101.

The pin 110 of the link member 106 and the pin 112 of the link member 107 are placed on the upper surface of the base plate 103 so as to be slidably or rotatably in the third engagement portion 113 or the fourth engagement portion 114 of the base plate 103. Here, explanation is made on one example of a relationship between the pin 112 engaged in the third engagement portion 113 and the base plate 103, referring to FIG. 18. FIG. 18 is a schematic explanatory view of the engagement relation of the pin 112 with the third engagement portion 113 of the base plate 103 in the conventional key switch, device 100; FIG. 18(*a*) is a perspective partial view of the pin 112 engaged in the third engagement portion 113; and FIG. 18(*b*) is a sectional view of FIG. 18(*a*).

In FIGS. 18(*a*) and 18(*b*), the pin 112 of the link member 107 is rotatably engaged in the third engagement portion 113, when the lower surface of the third engagement portion 113 and the upper surface of the base plate 103 rotatably support the pin 112 and restrict the rotation of the pin 112. In this state, the pin 112 is placed on the base plate 103 as shown in FIGS. 18(*a*) and (*b*).

Since the pin 112 is disposed on and supported by the upper surface of the base plate 103 as mentioned above, when the drawing quantity of the third engagement portion 113 is not set to be larger than a given processing quantity, the third engagement portion 113 can not properly hold the engagement pin 112 so as to be rotatable. Accordingly, it is impossible to reduce the processing quantity from a viewpoint of a drawing process for the third engagement portion 113.

Since the pin 112 is disposed on the upper surface of the base plate 103, the height of the key switch 100 would increase in proportion to at least the thickness of the base plate 103. Due to this, it is difficult to satisfy a current request to promote the thinning of a key switch device.

Furthermore, the tendency to reduce the height of the key switch device 100 constituting a key board attached to note type personal computers and note type word processors increases year by year. This thinning tendency can be accomplished by thinning the key top 101 itself.

However, when the key top 101 is formed a thin shape in response to the tendency of a thin key switch device, the key top 101 may be deformed due to its reduced thickness. Such the deformation would provide a bad appearance. In addition, it becomes more difficult to ensure keystroke as the key switch device 100 is further thinned. This deteriorates key operability.

SUMMARY OF THE INVENTION

The present invention has been made in view of the above circumstances and has an object to overcome the above problems and to provide a thin key switch device which has engagement portions formed in a base plate at a reduced processing quantity as compared with a conventional key switch device by effectively utilizing the thickness of the base plate.

Another object of the present invention in providing a key switch device capable of increasing a keystroke quantity while reducing a height of a key top arranged in the key switch device, thereby realizing a low profile key switch device.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a key switch device including a key top provided, on its back surface, with a first engagement portion and a second engagement portion, a base plate provided with a third engagement portion corresponding to the first engagement portion of the key top and a fourth engagement portion corresponding to the second engagement portion of the key top, a guide support member for guiding vertical movement of the key top, the guide support member being disposed between the key top and the base plate and constructed of a first and second link members mutually movably arranged, the first link member being provided with a first shaft engaged in the first engagement portion and a fourth shaft engaged in the fourth engagement portion, and the second link member being provided with a second shaft engaged in the second engagement portion and a third shaft engaged in the third engagement portion, a first shoulder portion formed close to the fourth shaft in the first link member, the first shoulder portion being recessed inwardly from a lower end surface of the fourth shaft and held in contact with an upper surface of the base plate, a second shoulder portion formed close to the third shaft in the second link member, the second shoulder portion being recessed inwardly from a lower end surface of the third shaft and held in contact with the upper surface of the base plate, and a switching member which performs a switching operation in response to the vertical movement of the key top.

According to the above key switch device, the first and second link members are formed with the first and second shoulder portions respectively disposed close to the fourth and third shafts engaged in the fourth and third engagement portions of the base plate so that the shoulder portions are spaced inwardly from the lower end surfaces of the shafts. The shoulder portions are also held in contact with the upper surface of the base plate. Thus, the lower part of the shaft can be positioned lower than the upper surface of the base plate. Even if the third and fourth engagement portions are formed in the base plate at a reduced processing quantity, therefore, the third and fourth shafts can be engaged in the third and fourth engagement portions without interfering with a vertical movement of the key top. Consequently, a thin key switch device can be achieved.

According to another aspect of the present invention, there is provided a key switch device including a key top provided, on its back surface, with a first engagement portion and a second engagement portion, a base plate provided with a third engagement portion corresponding to the first engagement portion of the key top and a fourth engagement portion corresponding to the second engagement portion of the key top, a guide support member for guiding vertical movement of the key top, the guide support member being disposed between the key top and the base plate and constructed of a first and second link members mutually movably arranged, the first link member being provided with a first shaft slidably engaged in the first engagement portion and a fourth shaft slidably engaged in the fourth engagement portion, and the second link member being provided with a second shaft rotatably engaged in the second engagement portion and a third shaft rotatably engaged in the third engagement portion, a switching member which performs a switching operation in response to the vertical movement of the key top.

In the above key switch device, the key top when depressed is moved downward rotating toward an operator side. Since such a downward motion of the key top is an arc motion, a stroke quantity can be increased in spite of a low-profile of the key switch device.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a key switch device embodying the present invention will now be given referring to the accompanying drawings.

Figure 16:
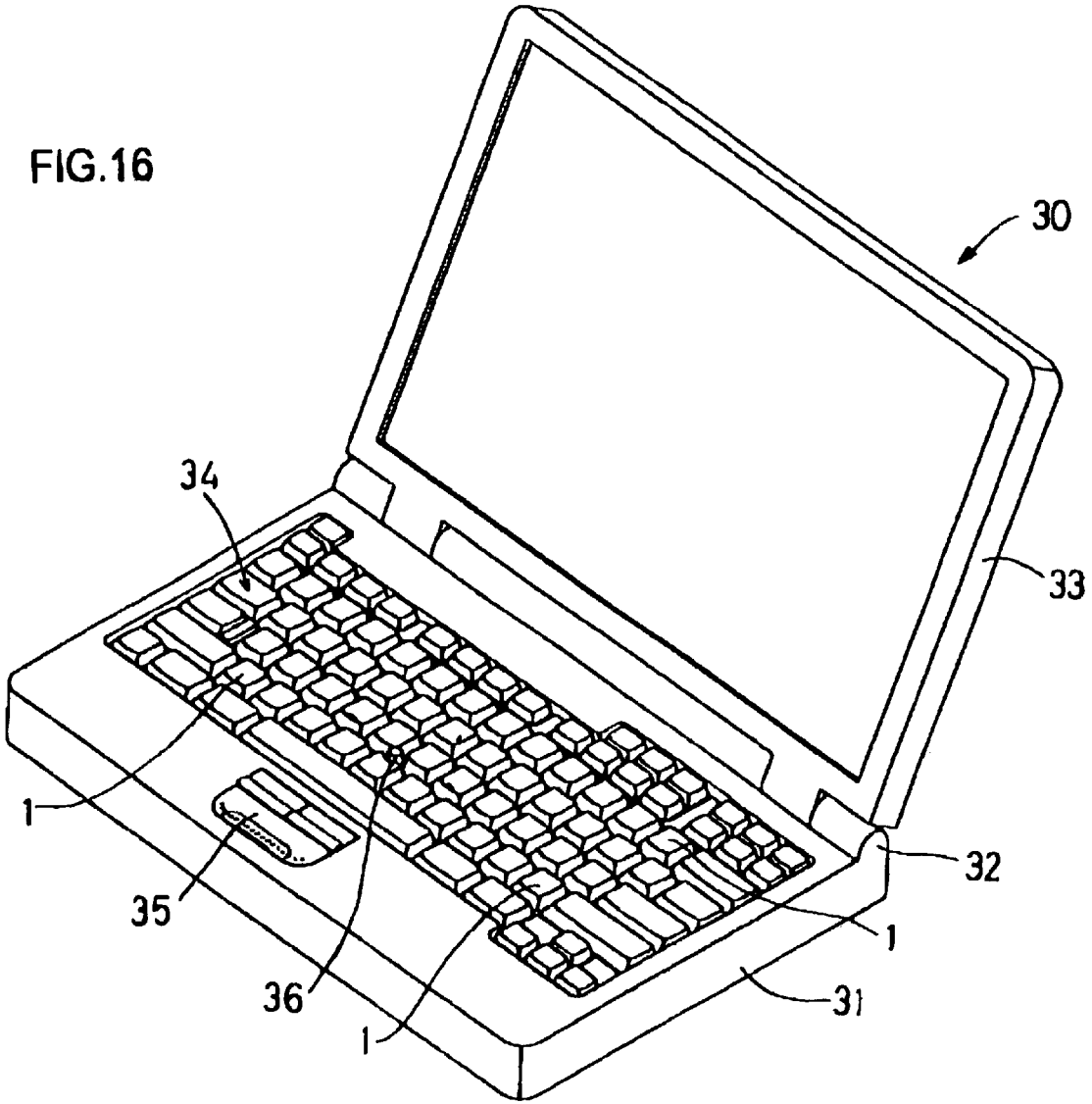
FIG. 16 is a perspective view of an electronic equipment provided with the key switch device in the present embodiment.
Figure 17:
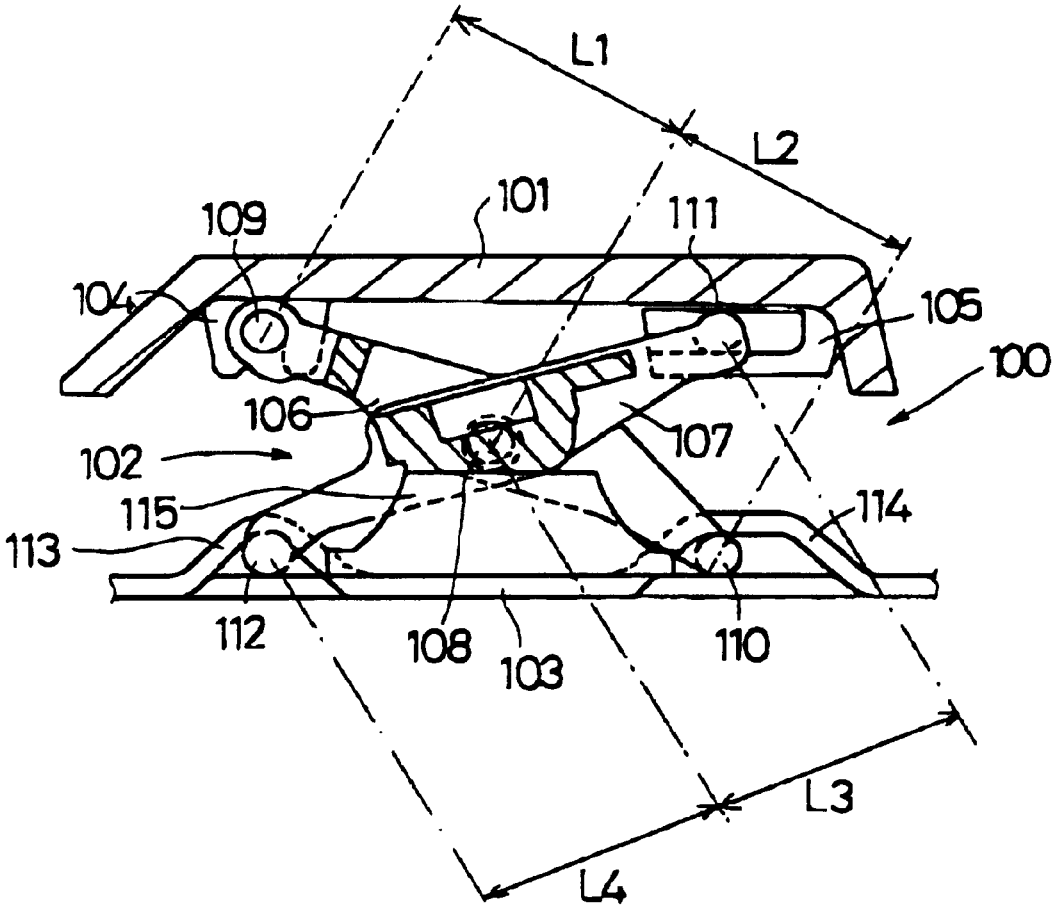
FIG.17 PRIOR ART
FIG. 17 is a side sectional view of a conventional key switch device.
Figure 18:
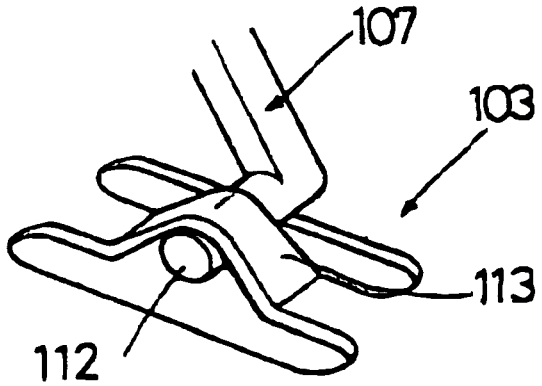
FIG. 18 (A) PRIOR ART
FIGS. 18(*a*) and 18(*b*) are explanatory views schematically showing an engagement relationship of a third engagement portion of a base plate and a pin in the conventional key switch device.
Figure 18:
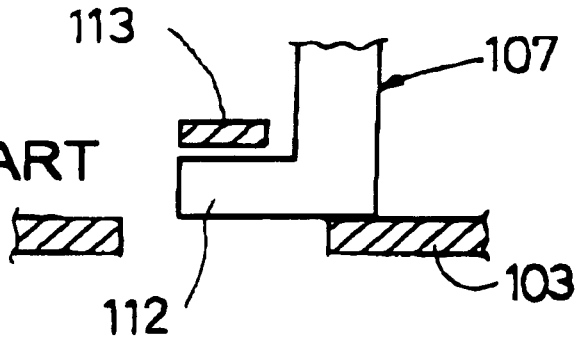
FIG. 18 (B) PRIOR ART
Figure 19:
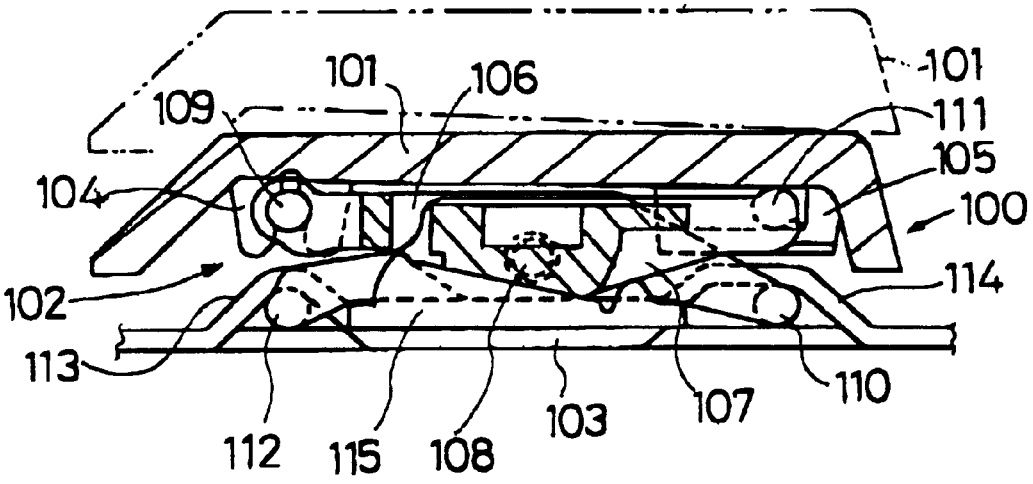
FIG.19 PRIOR ART
FIG. 19 is a side sectional view of the conventional key switch device of which a key top is in a depressed state.

In the present embodiment, the key switch device is used in an electronic equipment such as a note type personal computer, a note type word processor, and so on. FIG. 16 is a perspective view of an example of such the electronic equipment.

In FIG. 16, an electronic equipment 30 is mainly constructed of a main unit 31 including a CPU and a display 33 which is pivotally connected to the main unit 30 with a connecting portion 32 formed at one side end of the main unit 30. The main unit 30 is provided with a key board 34 having a plurality of key switch devices 1 and an auxiliary input portion 35. In the substantial center of the key board 34, there is also provided a stick member 36 constituting a pointing device which can be used for moving a cursor displayed on a screen of the display 33 in a longitudinal and lateral directions when a tip end of the stick member 36 is tilted in two-axis directions parallel to a key board plane, or which can provide a function corresponding to a left-click function of a mouse when the tip end of the stick member 36 is pushed down.

In the electronic equipment constructed as above, the key switch devices 1 on the key board 34 are operated to input a predetermined information to be displayed on the display 33 or instruct a predetermined operation to be processed in the CPU of the main unit 31.

Figure 1:
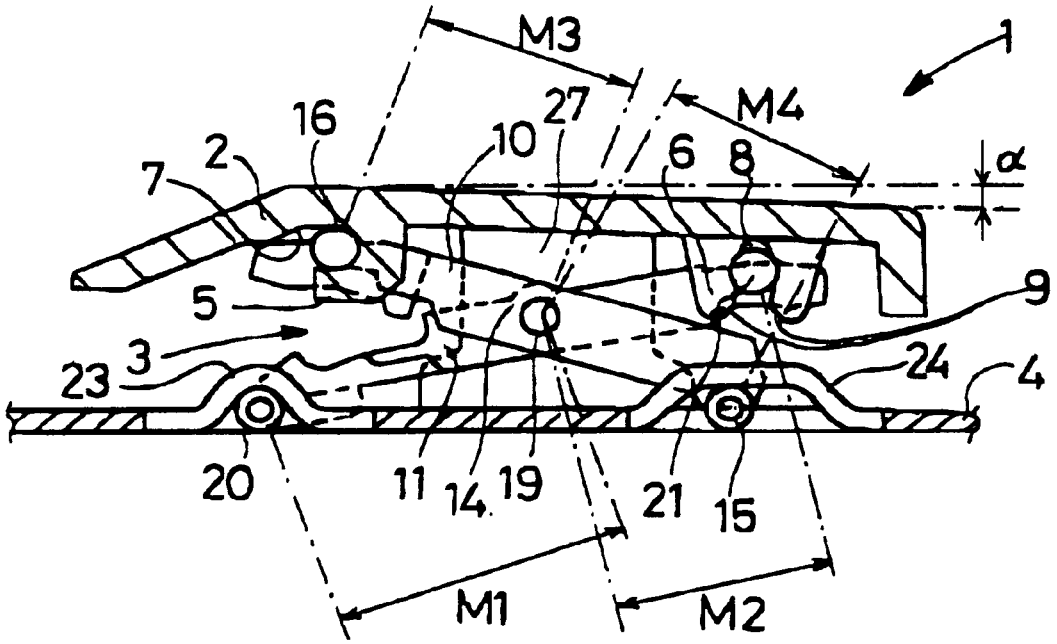
FIG. 1 is a sectional side view of a key switch device in an embodiment according to the present invention.

The key switch device 1 in the present embodiment will be hereinafter explained in detail. FIG. 1 is a sectional side view of the key switch device 1 of which a key top is in a non-depressed state.

The key switch device 1, as shown in FIG. 1, is mainly constructed of a key top 2, a guide support member 3, and a base plate 4 made of a thin aluminum plate.

The key top 2 is made of synthetic resin such as ABS resin and so on. Characters, symbols, and the like are printed on the key top 2. on the back surface of the key top 2, a pair of first engagement portions 5 and a pair of second engagement portions 6 are provided integrally with the key top body. It is to be noted that one each of the first and second engagement portions 5 and 6 are shown in FIG. 1. The first engagement portion 5 is formed on the key top 2 in its front side (in the left side in FIG. 1) and provided with a recess 7 which is open to the left side in the drawing. In the recess 7, as will be described later, a first engagement pin 16 of a first link member 10 constituting the guide support member 3 is slidably engaged. The second engagement portion 6 is formed on the key top 2 in its rear side (in the right side in FIG. 1) and provided with a hole 8 which is open to the lower side. In the hole 8, a second engagement pin 21 of a second link member 11 constituting the guide support member 3 is rotatably engaged.

The second engagement portion 6 is provided with sloping edges 9 at the open end of the hole 8, the sloping edges 9 serving to guide the pin 21 when snapped into the hole 8.

The guide support member 3 is the member for guiding the vertical movement of the key top 2 under operation and is constructed of the two first and second link members 10 and 11 coupled in an intersecting configuration to be mutually rotatable.

Figure 2:
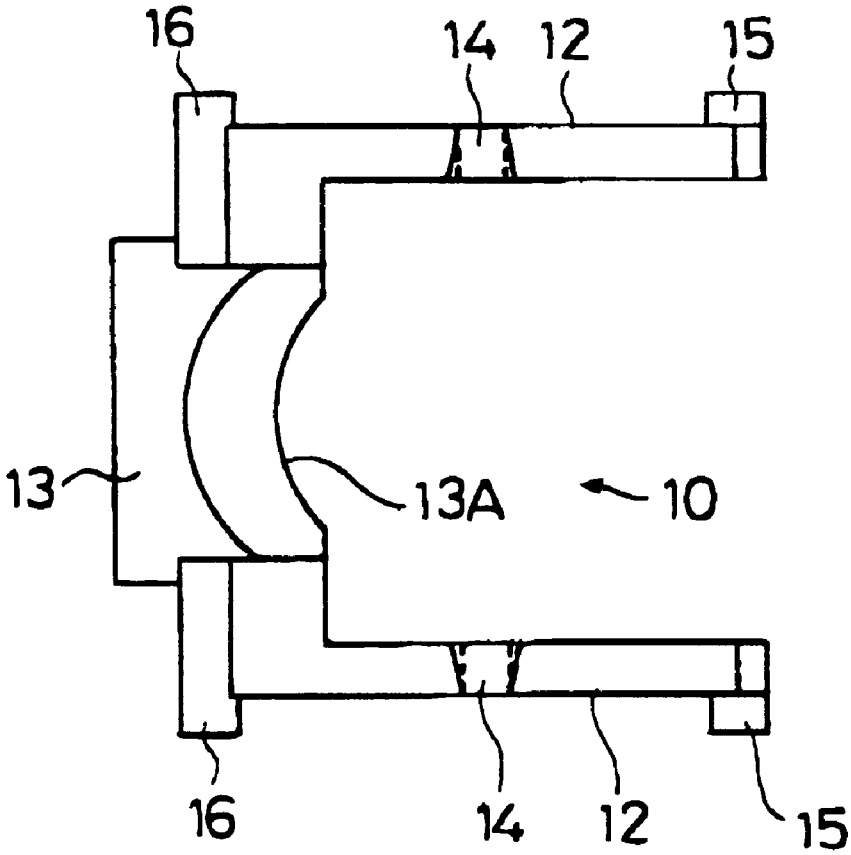
FIG. 2 is a plane view of a first link member of the key switch device in the embodiment.
Figure 3:
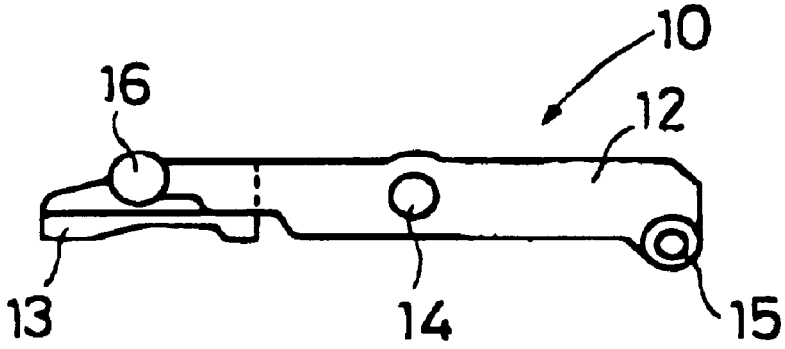
FIG. 3 is a front view of the first link member of FIG. 2.
Figure 4:
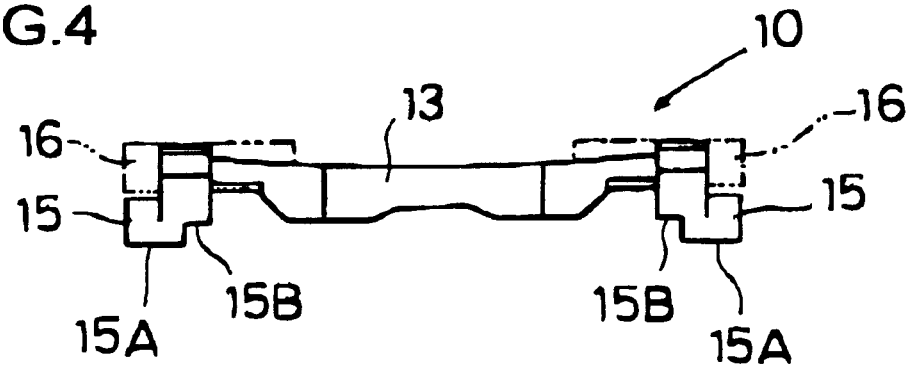
FIG. 4 is a right side view of the first link member of FIG. 3.

The first link member 10 is hereinafter explained in detail with reference to FIGS. 2–4. FIG. 2 is a plane view of the first link member 10; FIG. 3 is a front view of the first link member 10 of FIG. 2; and FIG. 4 is a right side view of the same. In those drawings, the first link member 10 is formed in an angular C-letter shape in plane configuration and has a construction that a pair of hinges 12 are integrally connected through a connecting portion 13. Axial support holes 14 are formed in the hinges 12 in a center so that the holes 14 are arranged opposing to each other. Fourth engagement pins 15 are formed outwardly extending from free ends of the hinges 12. In the other ends of the hinges 12 on the connecting portion side, first engagement pins 16 are formed. The fourth pins 15 are engaged slidably in longitudinal slot-like fourth engagement portions 24 formed on the base plate 4, which will be mentioned later. The first pins 16 are, on the other hand, engaged slidably in the recesses 7 of the first engagement portions 5 formed on the back surface of the key top 2. A curve portion 13A is formed in the inside of the connecting portion 13 as shown in FIG. 2.

Close to the fourth pin 15 to be engaged in the fourth engagement portion 24, as shown in FIG. 4, a shoulder 15B is recessed inward or upward from a lower end surface 15A of the pin 15. This shoulder 15B is in contact with the upper surface of the base plate 4 (see FIG. 11), as will be mentioned later.

Figure 5:
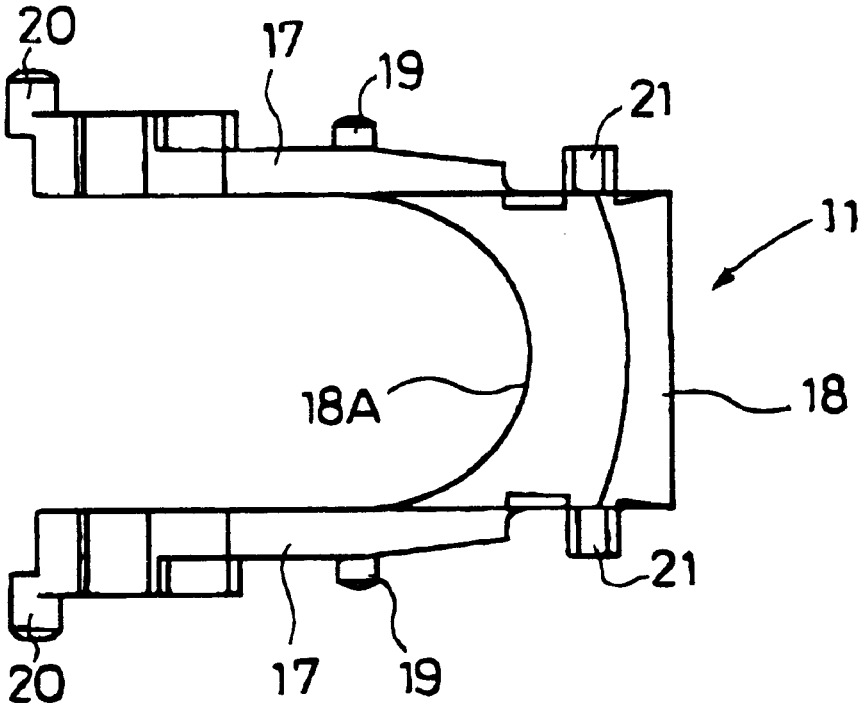
FIG. 5 is a plane view of a second link member in the present embodiment.
Figure 6:
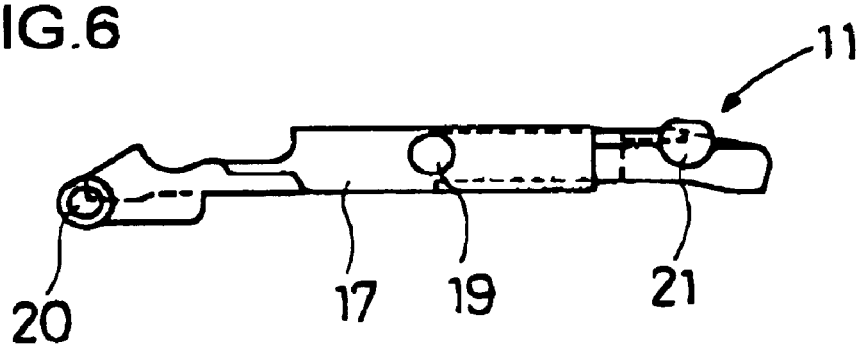
FIG. 6 is a front view of the second link member of FIG. 5.
Figure 7:
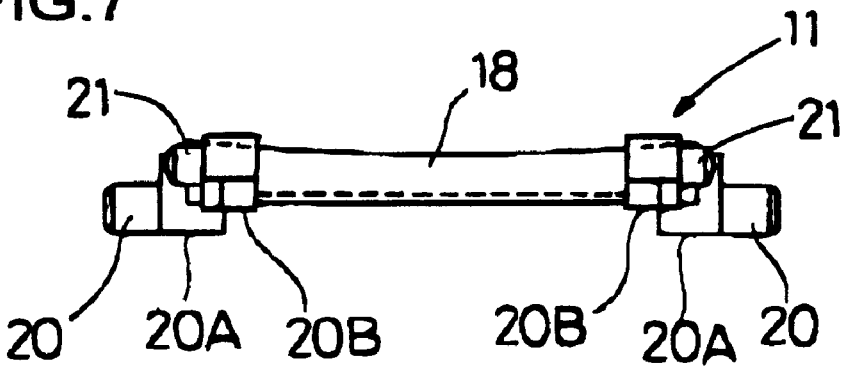
FIG. 7 is a right side view of the second link member of FIG. 6.

The second link member 11 is explained below with reference to FIGS. 5 to 7. FIG. 5 is a plane view of the second link member 2; FIG. 6 is a front view of the second link member 2 of FIG. 5; FIG. 7 is a right side view of the same. In those drawings, like the first link member 10, the second link member 11 is formed in an angular C-letter shape in plane configuration and has a construction that a pair of hinges 17 are integrally connected through a connecting portion 18. Shafts 19 are formed in the hinges 17 in a substantial center. These shafts 19 are axially supported in the axial support holes 14 of the hinges 12 of the first link member 10, so that the first link member 10 and the second link member 11 are coupled mutually rotatably with each other with the hinges 12 and 17 intersecting at the position where each of the shafts 19 engages in each of the holes 14. The third pins 20 are formed outwardly extending from free ends of the hinges 17. At both ends of the connecting portion 18, the second pins 21 are formed respectively. The third pins 20 are rotatably engaged in third engagement portions 23 (which will be mentioned later) of the base plate 4. The second pins 21 are rotatably engaged in the engagement holes 8 of the second engagement portions 6 formed on the back surface of the key top 2. A curve portion 18A is formed in the inside of the connecting portion 18 as shown in FIG. 5.

Close to the third pin 20 engaged in the third engagement portion 23, as shown in FIG. 7, a shoulder 20B is recessed inward or upward from a lower end surface 20A of the pin 20. This shoulder 20B is in contact with the upper surface of the base plate 4 (see FIG. 10), as will be mentioned later.

Figure 8:
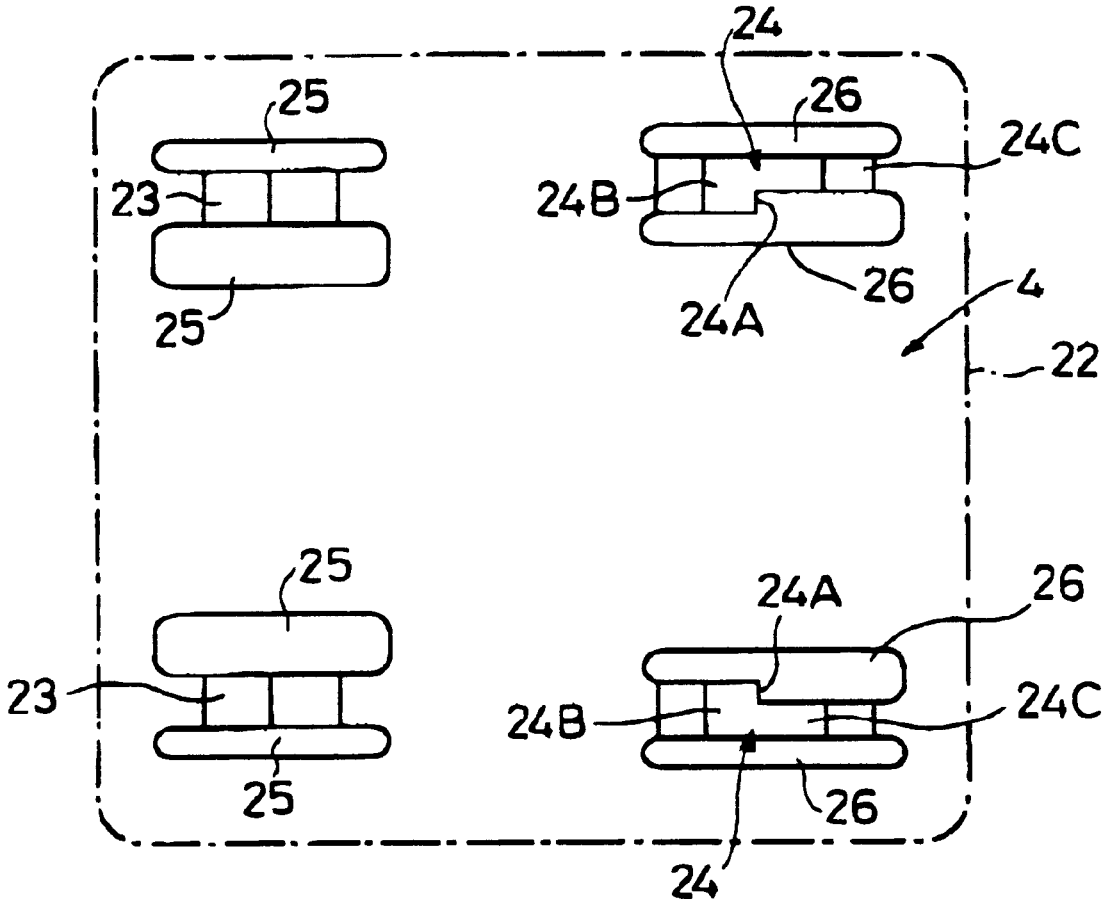
FIG. 8 is a plane view of a base plate corresponding to one key switch device.
Figure 9:
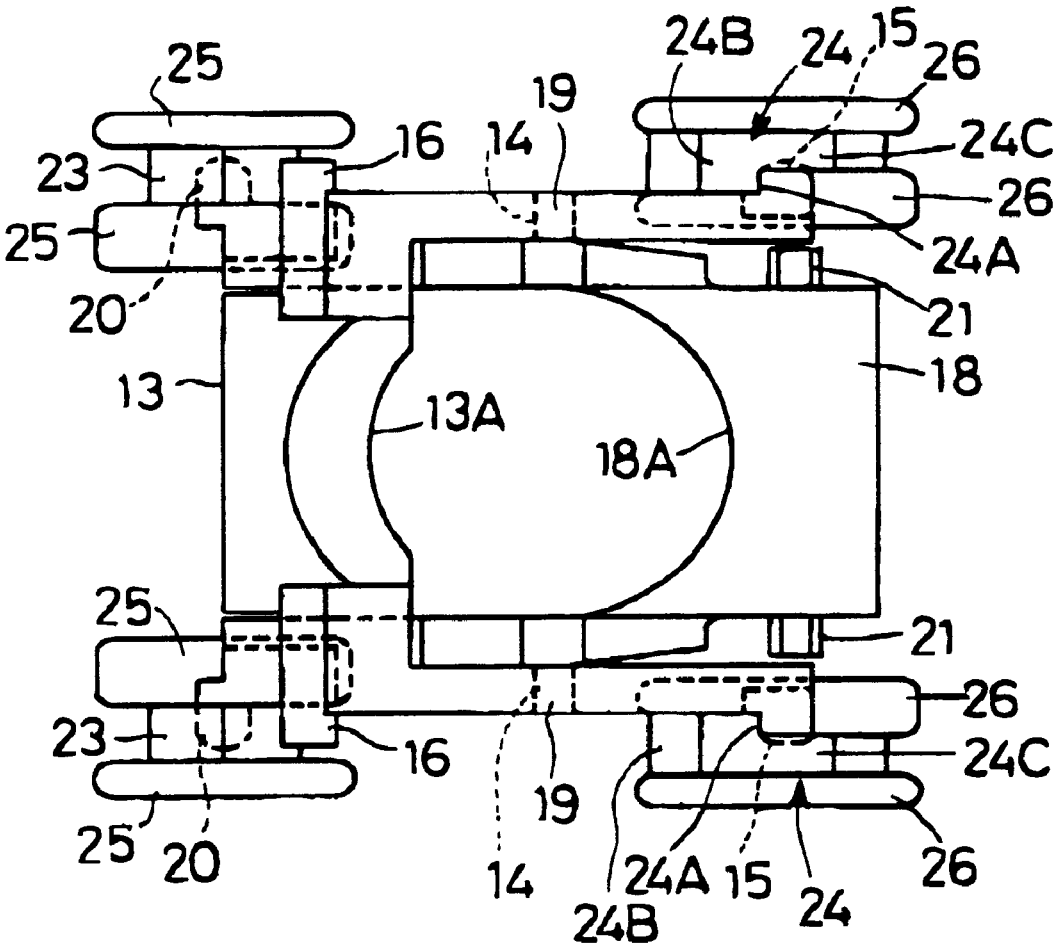
FIG. 9 is a plane view of a guide support member disposed on the base plate.

Next, the configuration of the base plate 4 made of a thin aluminum plate is described below with reference to FIGS. 8 and 9. FIG. 8 is a plane view of the base plate 4 corresponding to one key switch device 1; and FIG. 9 is a plane view of the guide support member 3 disposed on the base plate 4. The base plate 4 is provided, at four corners, with the third and fourth engagement portions 23 and 24 that have been formed respectively in pairs by a drawing process. Specifically, the third and fourth engagement portions 23 and 24 are formed by the following steps. At first, gaps 25 are punched in the base plate 4 on both sides of the work area which will form the third engagement portion 23. Gaps 26 are similarly punched on both sides of the work area which will form the fourth engagement portion 24. The area between the gaps 25 or 26 is then made into the third or fourth engagement portion having a predetermined shape by a drawing process.

Figure 10:
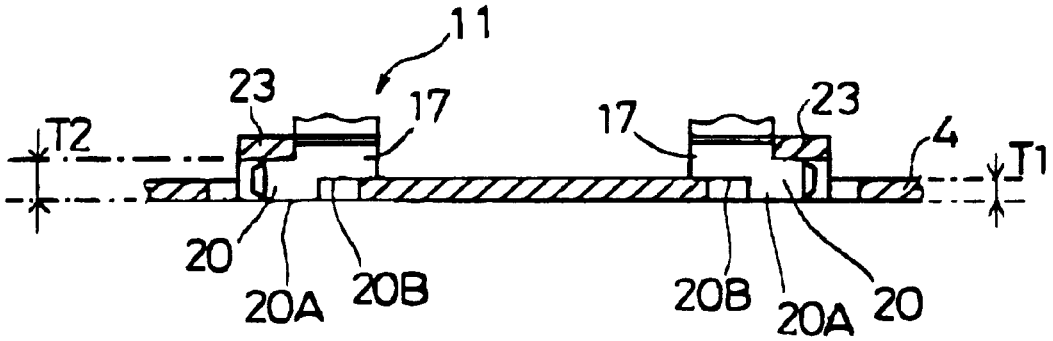
FIG. 10 is an explanatory view showing an engagement relationship between an engagement pin of the second link member and a third engagement portion of the base plate.
Figure 11:
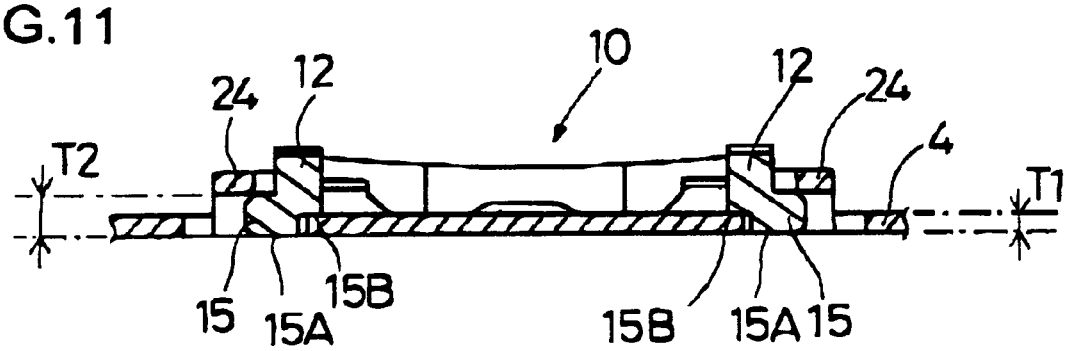
FIG. 11 is an explanatory view showing an engagement relationship between an engagement pin of the first link member and a fourth engagement portion.

The third engagement portion 23 is formed in a substantially triangle configuration protruding upward as shown in FIG. 1. In the triangle-shaped portion 23, the lower pin 20 of the second link member 11 is rotatably inserted. The fourth engagement portion 24 is formed in a substantially trapezoidal configuration rising upward from the base plate as shown in FIG. 1. In the trapezoid-shaped portion 24, the lower pin 15 of the first link member 10 is slidably inserted. As shown in FIGS. 8 and 9, the fourth engagement portion 24 is formed with a cut portion 24A whereby the fourth engagement portion 24 has a large width portion 24B in the left side and a small width portion 24C in the right side in the drawings. It is to be noted that a rubber spring 27 is disposed in the area defined by the curve portion 13A of the connecting portion 13 of the first link member 10 and the curve portion 18A of the connecting portion 18 of the second link member 11 (see FIG. 1). The rubber spring 27 is provided with a movable electrode (not shown) in an inner upper wall. In response to the downward or upward movement of the key top 2, a predetermined switching operation is conducted by contacting or releasing the movable electrode of the rubber spring 27 to or from a fixed electrode provided in a switching circuit (not shown) printed on the base plate 4. to Next, referring to FIGS. 10 and 11, explanation is made on the engagement relationship between the third pin 20 of the second link member 11 and the third engagement portion 23 and that between the fourth pin 15 of the first link member 10 and the fourth engagement portion 24. FIG. 10 is an explanatory view showing the relationship between the third pin 20 of the second link member 11. FIG. 11 is an explanatory view showing the relationship between the fourth pin 15 of the first link member 10 and the fourth engagement portion 24.

The relationship between the third pin 20 and the third engagement portion 23 in first explained with reference to FIG. 10. The shoulder 20B recessed inwardly from the lower end surface 20A of the pin 20 has the depth equal to the thickness T1 of the base plate 4 and thus the lower surface of the shoulder 20B is in contact with the upper surface of the base plate 4. Accordingly, as clearly shown in FIG. 10, the lower portion of the pin 20 can be positioned lower than the upper surface of the base plate 4. This makes it possible to reduce the drawing quantity of the third engagement portion 23 when formed in the base plate 4 to thereby prevent the third engagement portion 23 from being broken. In addition, the pin 20 can be engaged in the third engagement portion 23 without interfering with the vertical movement of the key top 2. A thin key switch device 1 is thus achieved.

The lower end surface 20A of the pin 20 is positioned within the thickness T1 of the base plate 4. In this case, the plate thickness can be effectively utilized. Like the above case, accordingly, the pin 20 can be engaged in the third engagement portion 23 without interfering with the vertical movement of the key top 2 even if the drawing quantity of the base plate 4 is reduced. This can realize a thin key switch device 1.

The drawing quantity T2 of the third engagement portion 23 is, as shown in FIG. 10, substantially equal to a shaft diameter of the pin 20 and is smaller than the total value of the base plate thickness T1 and the shaft diameter (which is substantially equal to T2) of the pin 20. In this regard, the key switch device 1 in the present embodiment differs from the conventional key switch device in which the entire lower surface of the pin is in contact with the upper surface of the base plate. As compared with the conventional key switch device, the base plate 4 can have a reduced drawing quantity T2 to achieve a thin key switch device 1.

The relationship between the fourth pin 15 and the fourth engagement portion 24 is described hereinafter, referring to FIG. 11. The same relationship as in the above case shown in FIG. 10 is also established in this case. Specifically, the shoulder 15B recessed inwardly from the lower end surface 15A of the pin 15 has the depth equal to the thickness T1 of the base plate 4 and thus the lower surface of the shoulder 15B is in contact with the upper surface of the base plate 4. Accordingly, as clearly shown in FIG. 11, the lower portion of the pin 15 can be positioned lower than the upper surface of the base plate 4. Accordingly, even when the fourth engagement portion 24 is formed in the base plate 4 at a reduced processing quantity by a drawing process, the pin 15 can be engaged in the fourth engagement portion 24 without cutting or breaking the fourth engagement portion 24 and interfering the vertical movement of the key top 2. A thin key switch device can thus be realized.

The lower end surface 15A of the pin 15 is positioned within the thickness T1 of the base plate 4, so that the plate thickness can be effectively utilized. Like the above case, accordingly, the pin 15 can be engaged in the fourth engagement portion 24 without interfering with the vertical movement of the key top 2 even if the drawing quantity of the base plate 4 is reduced. This can provide a thin key switch device 1.

Figure 12:
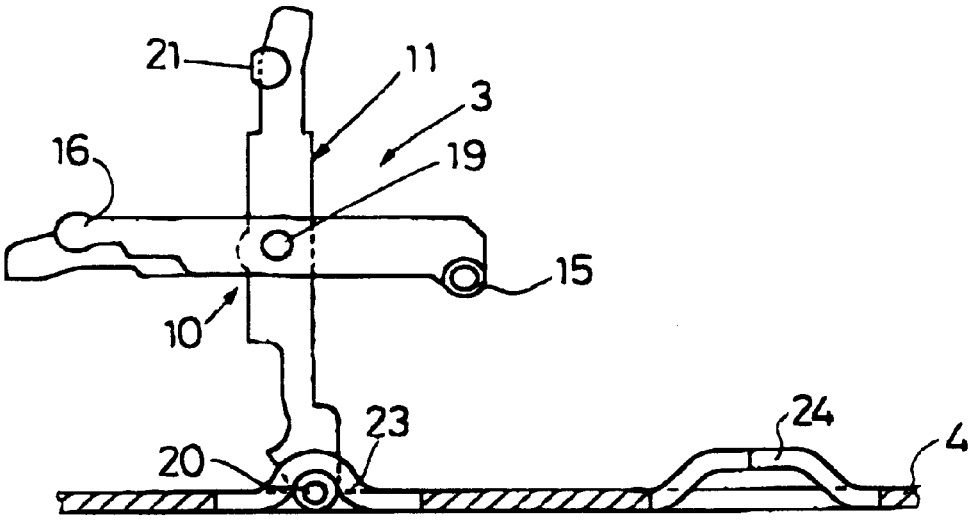
FIG. 12 is an explanatory view showing a state that the pin of the second link member of the guide support member has been engaged in the third engagement portion.
Figure 13:
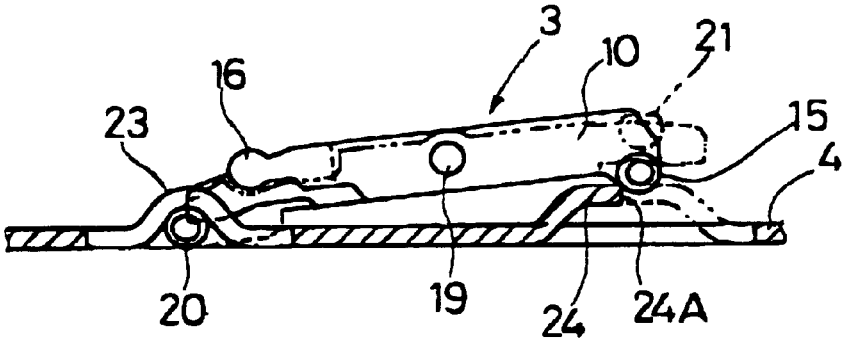
FIG. 13 is an explanatory view showing a state that the pin of the first link member is being engaged in the fourth engagement portion.
Figure 14:
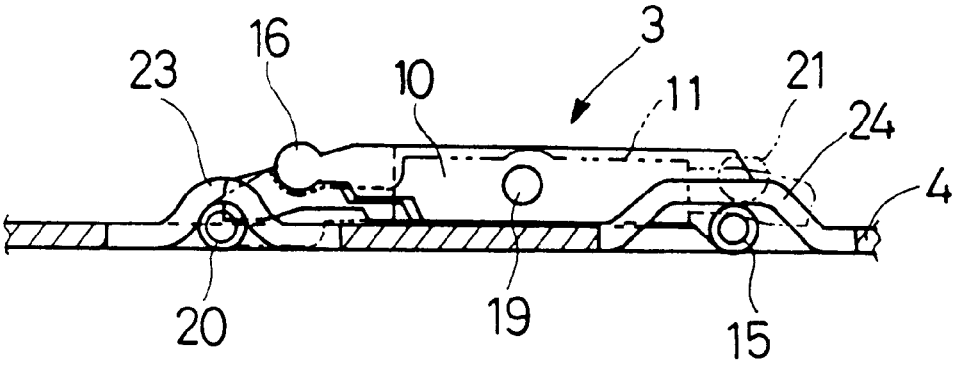
FIG. 14 is an explanatory view showing a state that the pin of the first link member has been engaged in the fourth engagement portion.

The drawing quantity T2 of the third engagement portion 24 is, as shown in FIG. 11, substantially equal to a shaft diameter of the pin 15 and is smaller than the total value of the base plate thickness T1 and the shaft diameter (which is substantially equal to T2) of the pin 15. In this regard, the key switch device 1 in the present embodiment differs from the conventional key switch device in which the entire lower surface of the pin is in contact with the upper surface of the base plate. As compared with the conventional key switch device, the base plate 4 can have a reduced drawing quantity T2 to realize a thin key switch device 1. Next, an assembling manner of the key switch device 1 is explained below with reference to FIGS. 12 to 14. FIG. 12 is an explanatory view showing a state that the pin 20 of the second link member 11 of the guide support member 3 has been engaged in the third engagement portion 23; FIG. 13 is an explanatory view showing a state that the pin 15 of the first link member 10 is being engaged in the fourth engagement portion 24; and FIG. 14 is an explanatory view showing a state that the pin 15 has been engaged in the fourth engagement portion 24.

The assembly of the key switch device 1 is begun by inserting the shafts 19 formed on the hinges 17 of the second link member 11 into the axial support holes 14 formed on the hinges 12 of the first link member 10 to thereby assemble the guide support member 3 with the first and second link member 10 and 11 mutually rotatably coupled in an intersecting configuration. Thereafter, each of the hinges 17 of the second link member 11 is slightly bent inward to insert the pin 20 into the third engagement portion 23 on the base plate 4 as shown in FIG. 12. When the pin 20 has been rotatably engaged in the engagement portion 23, the guide support member 3 is rotated clockwise so that the pin 15 of the first link member 10 is placed above the fourth engagement portion 24 as shown in FIG. 13.

The guide support member 3 shown in FIG. 13 is then slightly pushed down. As the fourth engagement portion 24 has the cut portion 24A, the pin 15 opposing the smaller width portion 24C can be fitted in the fourth engagement portion 24 as shown in FIG. 14.

In this way, the guide support member 3 is set on the base plate 4 by rotatably engaging the pin 20 of the second link member 11 in the third engagement portion 23 and slidably engaging the pin 15 of the first link member 10 in the fourth engagement portion 24. Then, while the first engagement portion 5 of the key top 2 is opposite to the pin 16 of the second link member 11 and the second engagement portion 6 is opposite to the pin 21 of the first link member 10 respectively, when the key top 2 is pushed a little down, the pin 16 is brought into elastic engagement with the recess 7 of the first engagement portion 5 and the pin 21 is brought into rotatable engagement with the hole 8 of the second engagement portion 6 through the slope 9.

When the rubber spring 27 is disposed on the base plate 4, the pin 15 of the first link member 10 is moved in the fourth engagement portion 24 through the small-width portion 24C against the elastic force of the rubber spring 27. Upon release of the pressure to the guide support member 3, the pin 15 is shifted leftward in FIG. 14 by the elastic return force of the rubber spring 27. The pin 15 is then placed under the large-width portion 24B of the fourth engagement portion 24 and is prevented from disengaging therefrom.

In the key switch device 1 constructed as above, as shown in FIG. 1, M1 indicates a first distance between the pin 20 of the second link member 11 engaged in the third engagement portion 23 of the base plate 4 and the center of the axial support hole 14 and the shaft 19 constituting the axial support part of the first and second link members 10 and 11, specifically the center of the shaft 19 (referred to as the shaft center hereinafter), M2 indicates a second distance between the shaft center and the pin 21 engaged in the second engagement portion 6 of the key top 2, M3 indicates a third distance between the shaft center and the pin 16 of the first link member 10 engaged in the first engagement portion 5 of the key top 2, and M4 indicates a fourth distance between the shaft center and the: pin 15 of the first link member 10 engaged in the fourth engagement portion 24 on the base plate 4. The first distance M1 is set to be longer than the second, third, and fourth distances M2–M4 which are set to be roughly equal in length.

Specifically, the relationship between the first, second, third, and fourth distances M1, M2, M3, and M4 is expressed as follows:

$$M1>M2\approx M3\approx M4$$

With such the relationship, the key top 2 inclines from the front side (key operator side), namely, the first engagement portion 5 side, to the second engagement portion 6 side. Thus, the key top 2 can have a step angle a, which enables improvement in key operability in an ergonomic view.

In the key switch device 1, as shown in FIG. 1, the pin 16 of the first link member 10 engaged in the first engagement portion 5 is offset to the right side with respect to the pin 20 of the second link member 11 engaged in the third engagement portion 23, and also the pin 21 of the second link member 11 engaged in the second engagement portion 6 is offset to the right side with respect to the pin 15 of the first link member 10 engaged in the fourth engagement portion 24. When the key top 2 is depressed, therefore, the pins 16 and 21 are stopped at the positions offset to the right side with respect to the pins 20 and 15 respectively.

Figure 15:
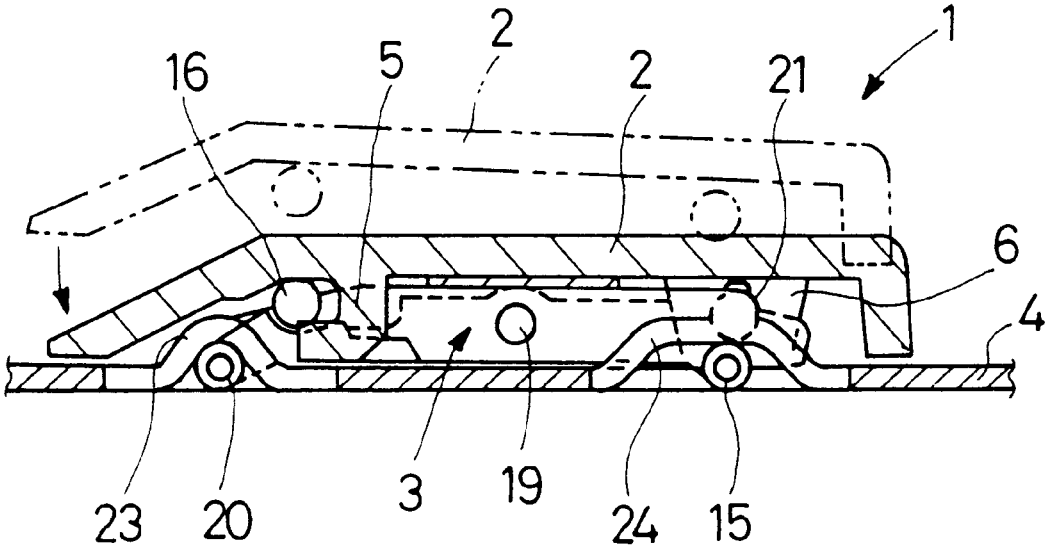
FIG. 15 is a side sectional view of the key switch device of which a key top is in a depressed state.

To operate the key switch device 1 assembled in the above manner, when the key top 2 is depressed against the elastic force of the rubber spring 27, it is moved, in an downward arc, rotating toward the operator side (in a lower left direction in FIG. 1). In response to the downward motion of the key top 2, the first and the second link members 10 and 11 of the guide support member are mutually rotated while causing the pin 16 of the first link member 10 to slide leftward in the first engagement portion 5 and the pin 15 to slid rightward in the fourth engagement potion 24, and simultaneously causing the pin 21 of the second link member 11 to rotate in the second engagement portion 6 and the pin 20 to rotate in the third engagement portion 23. When the depressing force to the key top 2 exceeds a fixed level, the rubber spring 27 is buckled and the movable electrode of the spring 27 is brought into contact with the fixed electrode of the switch circuit on the base plate 4. Thus, a switching operation is carried out. This state is shown in FIG. 15.

Upon release of the depressing force to the key top 2, the above mentioned operation is carried out in reverse order. The key top 2 is thus moved upward by the elastic return force of the rubber spring 27 to the state shown in FIG. 1.

The key switch device 1 in the present embodiment is configured, as mentioned above, such that the shoulder 20B formed close to the inside of the pin 20 has the depth equal to the thickness T1 of the base plate 4 and the lower surface of the shoulder 20B is in contact with the upper surface of the base plate 4, the shoulder 15B formed close to the inside of the pin 15 has the depth equal to the thickness T1 of the base plate 4 and the lower surface of the shoulder 15B is in contact with the upper surface of the base plate 4. Thus, the lower portions of the pins 20 and 15 can be disposed lower than the upper surface of the base plate 4. Accordingly, the third engagement portion 23 and the fourth engagement portion 24 can be formed in the base plate 4 by a drawing process at a reduced drawing quantity, which prevents the third and fourth engagement portions 23 and 24 from being cut or broken. The pins 20 and 15 can be engaged in the third and fourth engagement portions 23 and 24 respectively without interfering with the vertical movement of the key top 2. Thus, a thin key switch device 1 can be realized.

The lower end surface 20A of the pin 20 and the lower end surface 15A of the pin 15 are positioned within the thickness T1 of the base plate 4, so that the effective use of the thickness of the base plate 4 can be developed. This makes it possible to engage the pins 20 and 15 in the third and fourth engagement portions 23 and 24 respectively without interfering with the vertical movement of the key top 2 even if the drawing quantity on the base plate 4 is reduced to provide a thin key switch device 1.

Furthermore, since the drawing quantity T2 of the third and fourth engagement portions 23 and 24 are substantially equal to the shaft diameter of the pins 20 and 15, the drawing quantity T2 can be set to be smaller than the total value of the thickness T1 of the base plate 4 and the shaft diameter (which is substantially equal to T2) of the pins 20 and 15. Differing in this regard from the conventional key switch device in which the whole lower end surface of the pin is contact with the upper surface of the base plate, the key switch device 1 in the present embodiment having the reduced drawing quantity T2 can be reduced in thickness as compared with the prior art device.

As mentioned above, the key switch device 1 in the present embodiment is configured such that the pin 16 of the first link member 10 constituting the guide support member 3 is slidably engaged in the first engagement portion 5 of the key top 2 while the pin 15 is slidably engaged in the fourth engagement portion 24 of the base plate 4, and the pin 21 of the second link member 11 is rotatably engaged in the second engagement portion 6 of the key top 2 while the pin 20 is rotatably engaged in the third engagement portion 23 of the base plate 4. Accordingly, the key top 2 when depressed is moved downward, rotating toward the operator side. This downward motion of the key top 2 that is an arc motion enables the increase of a keystroke quantity in spite of a low-profile of the key switch device 1.

In the state that the key top 2 is fully depressed, the pins 16 and 21 are stopped at the positions offset to the right side with respect to the pins 20 and 15 respectively. This makes it possible to ensure the increase in a keystroke quantity despite a low-profile of the key switch device 1, so that a thin key switch device 1 can be realized without generating any trouble in keystroke even if the key top 2 is low in height.

The present invention may be embodied in other specific forms without departing from the spirit or essential characteristics thereof.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A key switch device including:

a key top having a back surface, the key top being provided with a first engagement portion and a second engagement portion on the back surface;

a base plate provided with a third engagement portion corresponding to the first engagement portion of the key top and a fourth engagement portion corresponding to the second engagement portion of the key top;

a guide support member for guiding vertical movement of the key top, the guide support member being disposed between the key top and the base plate and constructed of a first and second link members mutually movably arranged, the first link member being provided with a first shaft engaged in the first engagement portion and a fourth shaft engaged in the fourth engagement portion, and the second link member being provided with a second shaft engaged in the second engagement portion and a third shaft engaged in the third engagement portion;

a first shoulder portion formed close to the fourth shaft in the first link member, the first shoulder portion being recessed inwardly from a lower end surface of the fourth shaft and held in contact with an upper surface of the base plate;

a second shoulder portion formed close to the third shaft in the second link member, the second shoulder portion being recessed inwardly from a lower end surface of the third shaft and held in contact with the upper surface of the base plate; and a switching member which performs a switching operation in response to the vertical movement of the key top.

2. The key switch device according to claim 1, wherein the base plate has a predetermined thickness, the lower end surface of the fourth shaft is positioned within the thickness of the base plate due to the first shoulder portion being in contact with the upper surface of the base plate, and the lower end surface of the third shaft is positioned within the thickness of the base plate due to the second shoulder portion being in contact with the upper surface of the base plate.

3. The key switch device according to claim 2, wherein the first and second shoulder portions are formed with a depth equal to the thickness of the base plate.

4. The key switch device according to claim 3, wherein the base plate is made of a thin metal plate, and the third and fourth engagement portions are formed on the base plate by a drawing process.

5. The key switch device according to claim 4, wherein a drawing quantity of the base plate is set to be substantially equal to a shaft diameter of the third and fourth shafts, so that the drawing quantity is smaller than a total value of the base plate thickness and the shaft diameter of the third or fourth shaft.

6. The key switch device according to claim 4, wherein the third engagement portion is formed by the drawing process on a first work area after gaps have been formed by a punching work on both sides of the first work area, and the fourth engagement portion is formed by the drawing process on a second work area after gaps have been formed by the punching work on both sides of the second work area.

7. The key switch device according to claim 6, wherein the fourth engagement portion is provided with a cut portion to form a small-width portion and a large-width portion in the fourth engagement portion.

8. The key switch device according to claim 7, wherein the fourth shaft enters in the fourth engagement portion from the small-width portion by the cut portion and is engaged in the large-width portion.

9. The key switch device according to claim 8, further including a spring member which urges the key top upward, wherein the fourth shaft is engaged in the large-width portion of the fourth engagement portion by an urging force of the spring member when the key top is in a non-depression state.

10. The key switch device according to claim 1, wherein each of the first and second link members is constructed of a pair of hinges integrally connected with a connecting portion so as to form a substantially angular C-letter shape in plane configuration, the connecting portion having a curved portion.

11. The key switch device according to claim 10, further including a spring member which urges the key top upward, wherein the spring member is disposed in a space surrounded by the curved portions of the connecting portions of the first and second link members.

12. The key switch device according to claim 1, wherein the first and fourth shafts of the first link member are slidably engaged in the first engagement portion of the key top and the fourth engagement portions of the base plate respectively, and the second and third shafts of the second link member are rotatably engaged in the second engagement portion of the key top and the third engagement portions of the base plate respectively.

13. The key switch device according to claim 12, wherein, when the key top is in a non-depressed state, the first shaft of the first link member engaged in the first engagement portion and the third shaft of the second link member engaged in the third engagement portion are offset in a horizontal direction with respect to each other, and the second shaft of the second link member engaged in the second engagement portion and the fourth shaft of the first link member engaged in the fourth engagement portion are offset in a horizontal direction with respect to each other, and when the key top is in a depressed state, the first shaft of the first link member engaged in the first engagement portion and the third shaft of the second link member engaged in the third engagement portion are stopped at a position where the first and third shafts are offset in the horizontal direction with respect to each other, and the second shaft of the second link member engaged in the second engagement portion and the fourth shaft of the first link member engaged in the fourth engagement portion are stopped at a position where the second and fourth shafts are offset in the horizontal direction with respect to each other.

14. An electronic equipment provided a key switch device including:

a key top having a back surface, the key top being provided with a first engagement portion and a second engagement portion on the back surface;

a base plate provided with a third engagement portion corresponding to the first engagement portion of the key top and a fourth engagement portion corresponding to the second engagement portion of the key top;

a guide support member for guiding vertical movement of the key top, the guide support member being disposed between the key top and the base plate and constructed of a first and second link members mutually movably arranged, the first link member being provided with a first shaft slidably engaged in the first engagement portion and a fourth shaft slidably engaged in the fourth engagement portion, and the second link member being provided with a second shaft engaged in the second engagement portion and a third shaft rotatable engaged in the third engagement portion;

a first shoulder portion formed close to the fourth shaft in the first link member, the first shoulder portion being recessed inwardly from a lower end surface of the fourth shaft and held in contact with an upper surface of the base plate;

a second shoulder portion formed close to the third shaft in the second link member, the second shoulder portion being recessed inwardly from a lower end surface of the third shaft and held in contact with the upper surface of the base plate; and a switching member which performs a switching operation in response to the vertical movement of the key top.

15. A key switch device including:

a key top having a back surface, the key top being provided with a first engagement portion and a second engagement portion on the back surface;

a base plate provided with a third engagement portion corresponding to the first engagement portion of the key top and a fourth engagement portion corresponding to the second engagement portion of the key top;

a guide support member for guiding vertical movement of the key top, the guide support member being disposed between the key top and the base plate and constructed of a first and second link members mutually movably arranged, the first link member being provided with a first shaft slidably engaged in the first engagement portion and a fourth shaft slidably engaged in the fourth engagement portion, and the second link member being provided with a second shaft rotatably engaged in the second engagement portion and a third shaft rotatably engaged in the third engagement portion; and a switching member which performs a switching operation in response to the vertical movement of the key top, wherein the key top is moved downward with an arc motion based on an engaging relationship that both the first and fourth shafts in the first link member are made slidable and both the second and third shafts in the second link member are made rotatable, when the kev top is depressed.

16. The key switch device according to claim 15, wherein, when the key top is not depressed, the first shaft of the first link member engaged in the first engagement portion and the third shaft of the second link member engaged in the third engagement portion are offset in a horizontal direction with respect to each other, and the second shaft of the second link member engaged in the second engagement portion and the fourth shaft of the first link member engaged in the fourth engagement portion are offset in a horizontal direction with respect to each other, and when the key top is depressed, the first shaft of the first link member engaged in the first engagement portion and the third shaft of the second link member engaged in the third engagement portion are stopped at a position where the first and third shafts are offset in the horizontal direction with respect to each other, and the second shaft of the second link member engaged in the second engagement portion and the fourth shaft of the first link member engaged in the fourth engagement portion are stopped at a position where the second and fourth shafts are offset in the horizontal direction with respect to each other.

17. The key switch device according to claim 15, wherein the first and second link members are disposed to be mutually rotatable through an axial support portion with an axial support center, a first distance between the axial support center of the axial support portion and the third shaft is set to be larger than each of a second distance between the axial support center and the second shaft, a third distance between the axial support center and the first shaft, and a fourth distance between the axial support center and the fourth shaft, and the second, third, and fourth distances are set to be equal to each other.

18. An electronic equipment provided with a key switch device including:

a key top having a back surface, the key top being provided with a first engagement portion and a second engagement portion on the back surface;

a base plate provided with a third engagement portion corresponding to the first engagement portion of the key top and a fourth engagement portion corresponding to the second engagement portion of the key top;

a guide support member for guiding vertical movement of the key top, the guide support member being disposed between the key top and the base plate and constructed of a first and second link members mutually movably arranged, the first link member being provided with a first shaft slidably engaged in the first engagement portion and a fourth shaft slidably engaged in the fourth engagement portion, and the second link member being provided with a second shaft rotatably engaged in the second engagement portion and a third shaft rotatably engaged in the third engagement portion; and a switching member which performs a switching operation in response to the vertical movement of the key top, wherein the key top is moved downward with an arc motion based on an engaging relationship that both the first and fourth shafts in the first link member are made slidable and both the second and third shafts in the second link member are made rotatable, when the key top is depressed.

19. A key switch device including:

a key top having a back surface the key top being provided with a first engagement portion and a second engagement portion on the back surface;

a base plate provided with a third engagement portion corresponding to the first engagement portion of the key top and a fourth engagement portion corresponding to the second engagement portion of the key top;

a guide support member for guiding vertical movement of the key top, the guide support member being disposed between the key top and the base plate and constructed of a first and second link members mutually movably arranged, the first link member being provided with a first shaft slidably engaged in the first engagement portion, and a fourth shaft slidably engaged in the fourth engagement portion, and the second link member being provided with a second shaft rotatably engaged in the second engagement portion and a third shaft rotatably engaged in the third engagement portion;

a first shoulder portion formed close to the fourth shaft in the first link member, the first shoulder portion being recessed inwardly from a lower end surface of the fourth shaft and held in contact with an upper surface of the base plate;

a second shoulder portion formed close to the third shaft in the second link member, the second shoulder portion being recessed inwardly from a lower end surface of the third shaft and held in contact with the upper surface of the base plate; and a switching member which performs a switching operation in response to the vertical movement of the key top.

* * * * *